United States Patent [19]

Visser

[11] Patent Number: 4,563,859

[45] Date of Patent: Jan. 14, 1986

[54] METHOD AND APPARATUS FOR PACKAGING PRODUCTS

[75] Inventor: Berend L. Visser, Kalmthout, Belgium

[73] Assignee: Koninklijke Emballage Industrie Van Leer B.V., Amstelveen, Netherlands

[21] Appl. No.: 513,172

[22] Filed: Jul. 13, 1983

[51] Int. Cl.[4] ..... B65B 9/02

[52] U.S. Cl. ..... 53/450; 53/553

[58] Field of Search ..... 53/450, 553, 555, 550–552, 53/451, 209, 206

[56] References Cited

U.S. PATENT DOCUMENTS 3,289,386 12/1966 Farmer ..... 53/450
3,686,820 8/1972 Zenger et al. ..... 53/555 X
3,739,522 6/1973 Greenbaum ..... 53/450 X
3,807,117 4/1974 Abrams ..... 53/553 X
4,106,262 8/1978 Aterianus ..... 53/450

*Primary Examiner*—James F. Coan
*Attorney, Agent, or Firm*—Brumbaugh, Graves, Donohue & Raymond

[57] ABSTRACT

A method of packaging products comprising positioning the products between two opposed sheet portions of flexible plastics material at lengthwise spaced locations. The sheet portions are sealed together along lines transverse to the lengthwise direction thereof and at locations between adjacent pairs of said products. Thereby generally tubular compartments are formed within which the products extend in end to end direction transverse to said lengthwise direction and are retained.

12 Claims, 9 Drawing Figures

METHOD AND APPARATUS FOR PACKAGING PRODUCTS

This invention relates to a method and apparatus for packaging products.

According to this invention there is provided a method of packaging products comprising positioning the product between two opposed sheet portions of flexible plastics material, at lengthwise spaced locations, and sealing the sheet portions together along lines transverse to the lengthwise direction thereof and at locations between adjacent pairs of said products whereby to form generally tubular compartments which extend in end to end direction transverse to said lengthwise direction and within which the products are retained.

It is not necessary that the end to end dimension of the tubular compartments should be in excess of the end to end length of the products being packaged. That is to say, the products may extend from the compartments at one or both ends thereof.

The method of the invention may also be adapted to packaging of the products by a process wherein a first of the sheet portions is first laid down, the products are then disposed on the first sheet portion in spaced relationship, and a second of said sheet portions is then laid over the first laid sheet portion and products, whereafter said sealing is effected.

The invention also provides apparatus for packaging products comprising positioning means for positioning the products and two sheet portions of flexible plastic material such that the products are positioned between the sheet portions at spaced locations along the lengths of the sheet portions, and sealing means for sealing the sheet portions together, along lines transverse to the lengthwise direction of said sheet portions, at locations between adjacent pairs of said products whereby to form generally tubular compartments which extend in end to end directions transverse to said lengthwise direction and within which the products are retained.

The invention finds particular applicability in relation to packaging meat products such as carcases, but may be used for packaging other objects.

The invention is further described by way of example only with reference to the accompanying drawings in which:

FIG. 8 is a diagrammatic side elevation of another form of apparatus of the invention, for carrying out the method of FIGS. 2 to 4; and FIG. 9 is a plan view, partly sectioned, of the apparatus of FIG. 8.

Figure 1:
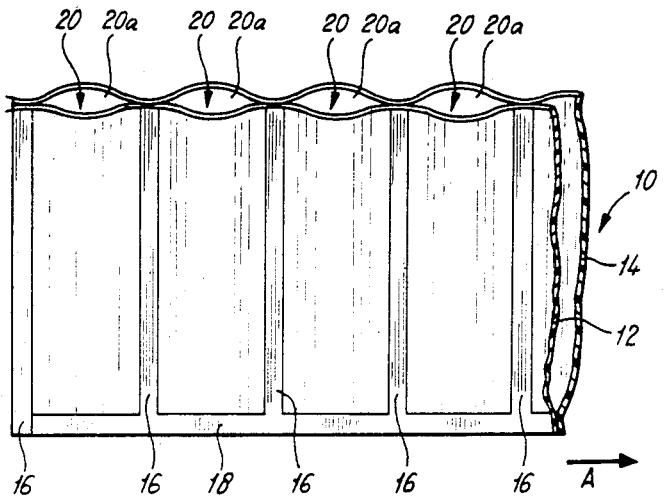
FIG. 1 is a diagram showing packaging in accordance with the invention.

In FIG. 1, a package 10 in accordance with the invention is shown as comprising two overlaid sheets 12, 14 of a heat sealable plastics material such as VALeRON (Registered Trade Mark). The sheets 12, 14 are heat sealed together along spaced lines 16 positioned along the direction of extent, indicated by arrow "A" of the sheets. The sheets are also sealed together at adjacent edges to one side of the package, more particularly along the line 18. At the other side of the package, the sheets are open.

By virtue of the above arrangement, there is disposed between each adjacent pair of lines 16, a separate open mouthed generally cylindrical compartment 20 the end to end directions of the compartments extending transversely to the lengthwise direction of the sheets 12, 14. The compartments 20 have open mouths 20*a* at end thereof remote from line 18 but are closed at the other sides by virtue of the sealing along line 18.

It is possible to package materials in the package 10 simply by inserting these into the open mouths 20*a* of the cylindrical compartments 20 and then, for complete retention if required, the compartments may be closed by sealing of the package to join the edges of the sheets 12, 14 together at the side of the package remote from line 18.

Figure 2:
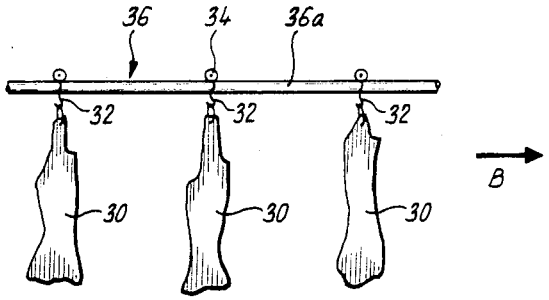
FIGS. 2, 3 and 4 are diagrams showing steps in the packaging of meat carcases in accordance with the invention.
Figure 3:
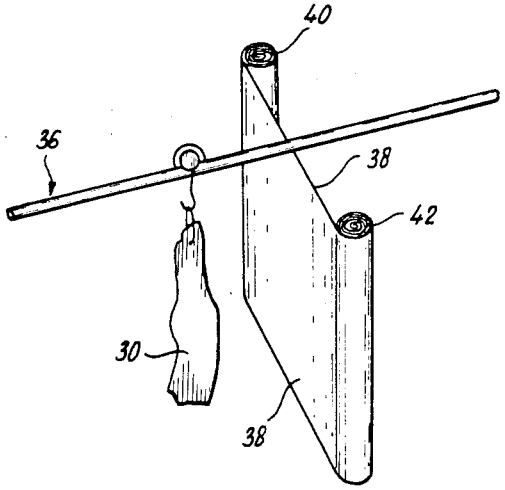
Figure 4:
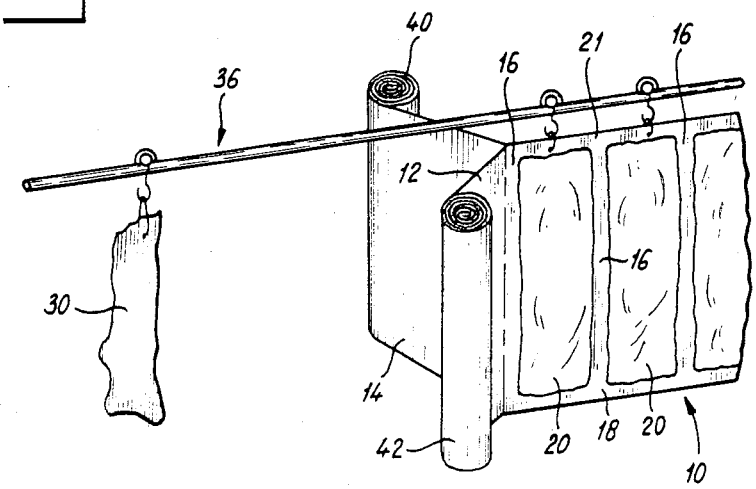

Referring now to FIGS. 2 to 4, FIG. 2 shows a series of carcases 30 suspended from hooks 32 on carriages 34 which carriages are retained on a rail 36*a* of a moving conveyor 36 for movement thereof together with the carcases 30 in the direction indicated by arrow "B".

In FIG. 3, one of the carcases 30 is shown being moved along conveyor 36 towards a wall 38 of the aforementioned plastics sheet material. The plastics sheet material is wound on two rolls 40, 42 which extend vertically and are positioned one to either side of the conveyor 36 with the sheet material defining the wall 38 extending therebetween.

As carcases 30 are moved on conveyor 36, a leading carcase 30 engages the wall 38 and, by unwinding of material from rolls 40 and 42, a partial wrapping of the first carcase occurs. Thus sheets equivalent to the sheets 12 and 14 previously mentioned and comprising respective portions of the wall 38 are moved to be positioned to either side of the carcase 30. As the carcase moves past the rolls 40, 42, these sheets 12, 14 become more or less parallel and are then heat sealed together along a line 16 immediately behind the leading carcase. Then, the upper and lower edges are sealed as indicated at lines 18, 21 to effect complete sealing of the first carcase. By this means, the carcases 30 are successively fed past the locations of the rolls 40, 42, to be sealed into the compartments 20 as shown in FIG. 4. Engagement between each carcase 30 and the seal line 16 immediately in front thereof causes driving engagement between the material forming sheets 14,12 for continuous outfeeding from rolls 40, 42.

Figure 5:
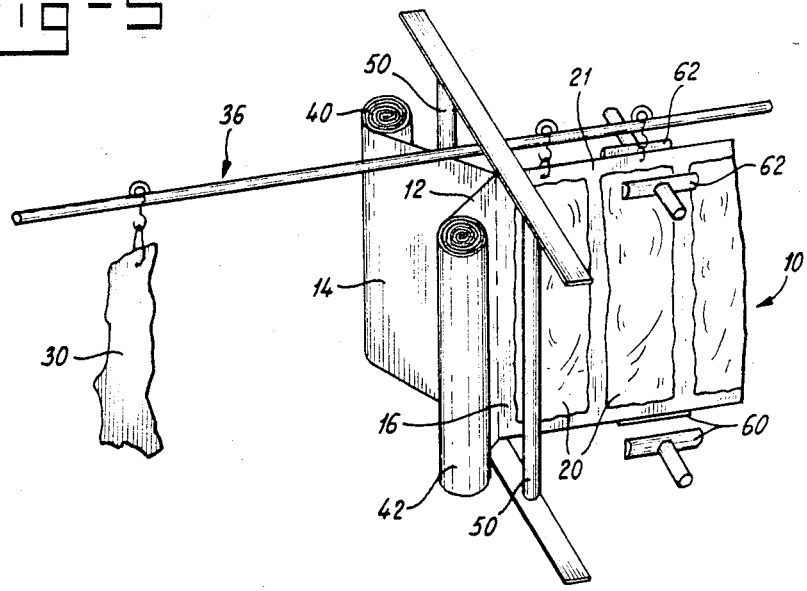
FIG. 5 is a perspective diagram showing an apparatus for effecting heat sealing in the method of FIGS. 2 to 4.

As shown in FIG. 5, the aforementioned heat sealing along the lines 16 may be effected by heat sealing bars 50 which extend vertically and are positioned one to either side of the conveyor 36 immediately behind the rolls 40, 42. These are moved inwardly towards each other to contact the sheets 12, 14 from either side. Sealing along the lines 18 and 21 may likewise be effected by bars 60, 62 which move in and out from opposed sides of the conveyor 36, these being generally horizontal and extending in the direction of extent of the conveyor 36.

Figure 6:
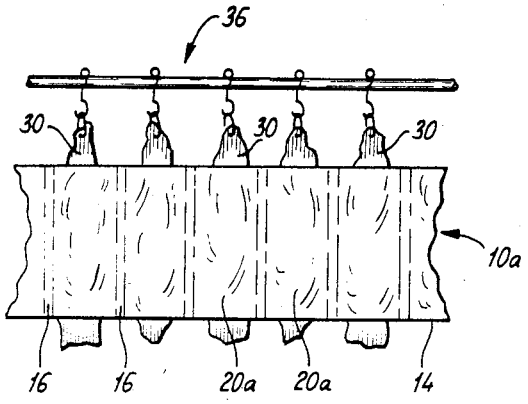
FIG. 6 illustrates a variation of the method of FIGS. 2 and 4.

FIG. 6 shows a package 10*a* where the height of the material comprising the sheets 12 and 14 is rather less than the overall height of the carcases 30 so that, instead of the carcases being completely retained in the tubular compartments 20*a*, the carcases extend at upper and lower ends therefrom. In this arrangement, the resultant packaging may simply be for the purpose of maintaining carcases in predetermined fixed relationships relative to each other.

Figure 7:
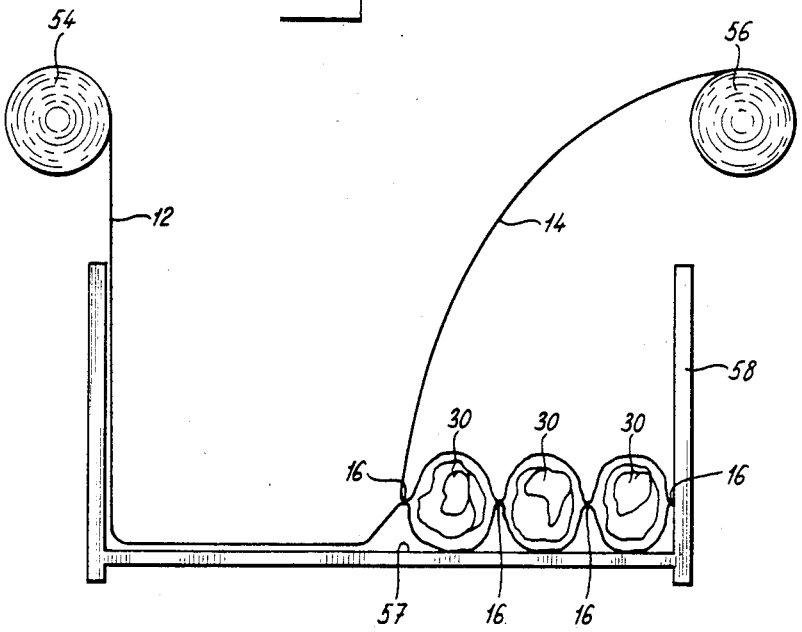
FIG. 7 is a side view of a stillage, and showing a method, in accordance with the invention, of packaging meat carcases on the stillage.
Figure 5:
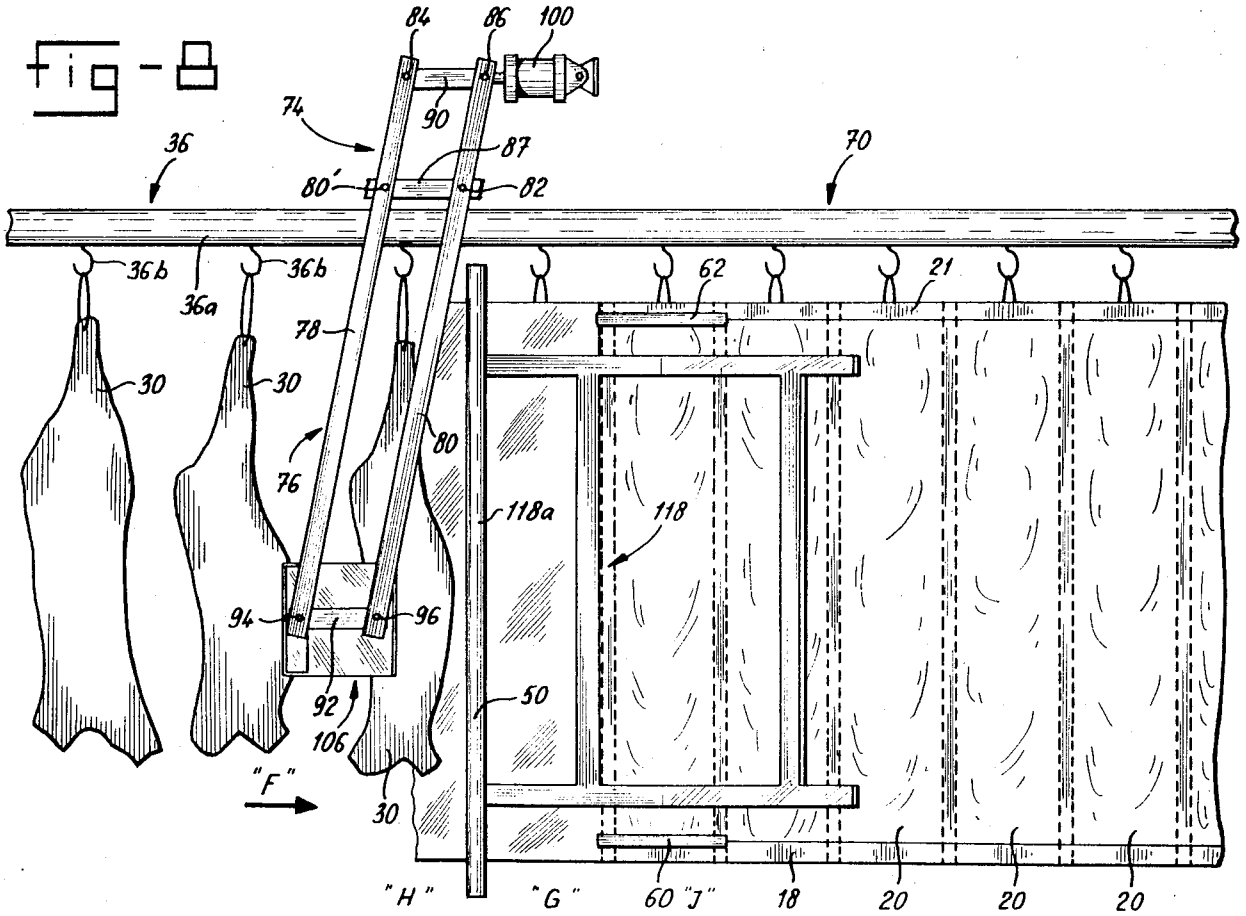
Figure 5:
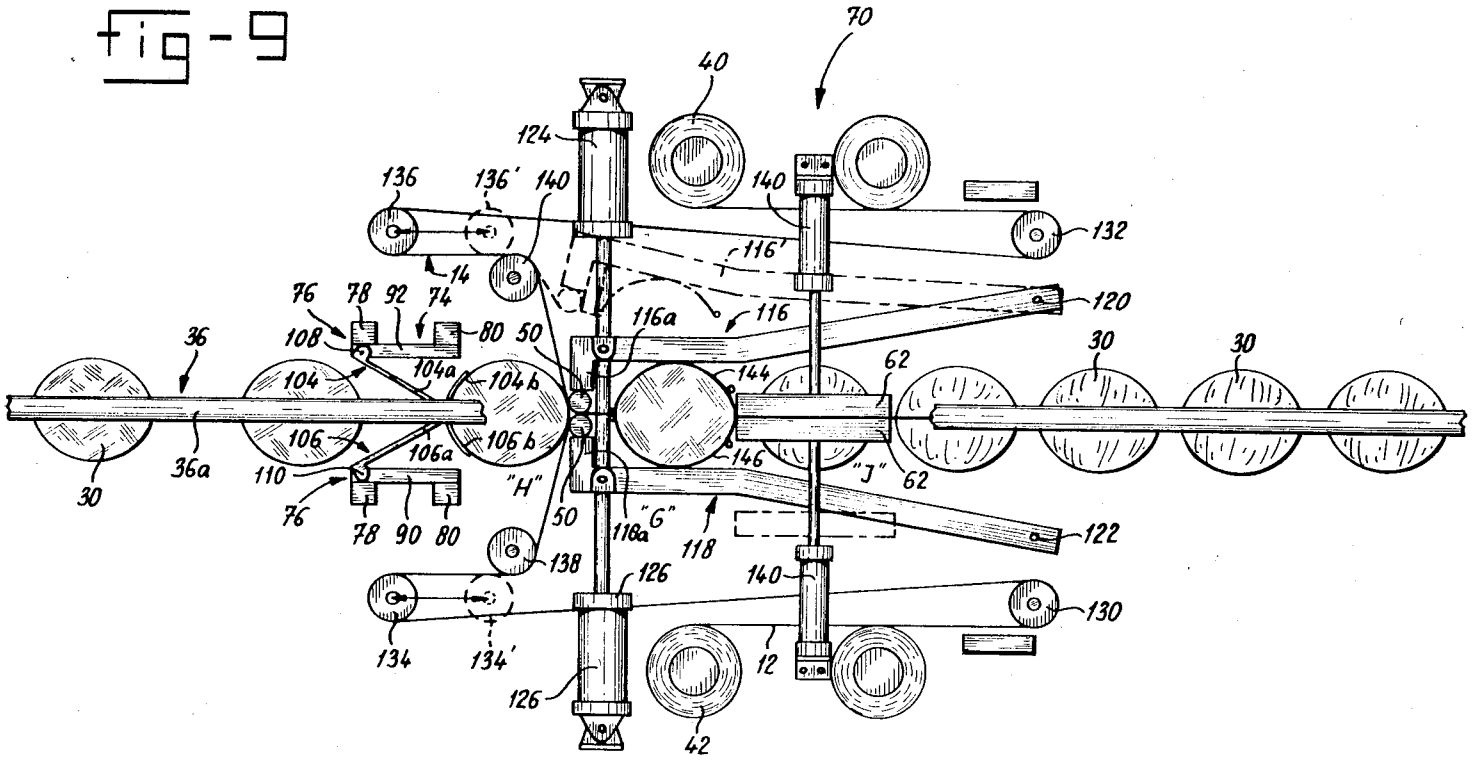

In FIG. 7, sheets 12, 14 are unwound from rolls 54, 56. Sheet 12 is first laid along the floor 57 of a stillage 58. Then, carcases 30 are laid thereon in parallel spaced relationship and sheet 14 overlaid and joined to the sheet 12 along the lines 16 as previously described. This may be effected by manual heat sealing apparatus.

The apparatus 70 of FIGS. 8 and 9 is generally similar to the apparatus shown in FIG. 5, and like reference numerals are used to designate like parts. More particularly, the apparatus 70 includes the aforementioned conveyor 36 comprising a rail 36*a* along which wheeled members 36*b* are moved, these having the carcases 30 tied thereto. The apparatus 70 also includes rolls 40 and 42 for providing the sheets 14 and 12 and vertical sealing bars 50 and horizontal sealing bars 60, 62.

In order to move the carcases 30 into position for encasement, the apparatus 70 includes a pusher mechanism 74. Mechanism 74 includes two like parallelogram linkages 76, one disposed to either side of the conveyor rail 36*a*. Each linkage 76 includes two generally upright elongate members 78, 80 which are pivoted to part 87 of a frame of the apparatus (not fully shown) at the locations 80, 82 somewhat above the conveyor 36, the locations 80, 82 being spaced along the length of the conveyor rail 36*a*. Upper ends of the members 78, 80 are pivotally interconnected at the locations 84, 86 shown with ends of a short link 90. Lower ends of the members 76, 80 are likewise pivotally interconnected by a short link 92 at the locations 94, 96 shown. The links 90 and 92 are of the same length and the spacing between the pairs of pivot locations 94, 96; 80, 82 and 84, 86 is the same. At upper ends, the links 90 of the two linkages 76 are connected together (by means not shown) and to the actuating plunger of a hydraulic or pneumatic ram 100 arranged to move the links 90 in the horizontal direction lengthwise of the direction of extent of the conveyor rail 36*a*.

At lower ends of the mechanism 74, the links 92 carry respective pusher elements 104, 106, these being pivotally interconnected thereto for pivotal movement about vertical axes. The locations of these axes are designated by reference numerals 108, 110 in FIG. 9 from which it will be seen that the pivot axes are adjacent end of the bars 92 first reached by carcases 30 as they move to the apparatus. Pusher elements 104, 106 are of like configuration comprising planar parts 104*a*, 106*a* which extend from the pivot points 110 in the direction of movement of carcass. The planar parts 104*a*, 106*a* are disposed upright and in such a fashion so as, normally, to be in the convergent formation illustrated in FIG. 9 with edges thereof remote from the pivot axes adjacent and located midway between the members 92, or directly below the conveyor 36. From these remote edges of the parts 104, 106*a*, extend respective outwardly divergent arcuate parts 104*b*, 106*b*, these being arranged so as to lie, when viewed in plan as shown in FIG. 9, on a common arc when the elements 104, 106 are positioned in the rest position. Elements 104, 106 can, however, be swung apart from each other so that the free edges thereof on the parts 104*b*, 106*b* are moved outwardly as viewed in FIG. 9 away from the path of movement of carcases through the apparatus. The elements 104, 106 are biased to the rest position shown in FIG. 9 by resilient means, such as springs (not shown).

In FIG. 8, mechanism 74 is shown at an extreme of movement thereof under the action of actuation of ram 100 and at this location, the members 78, 80 of each linkage 76 are swung so that the lower ends thereof, and the elements 104, 106 are moved to a location furtherest rearward in the direction of movement of carcases 30. By extending the ram 100, the lower ends of the member 78, 80 and the elements 104, 106 can however be moved in a "forward" direction indicated by arrow "F" in FIG. 8 so that the elements 104, 106 can engage a carcase 30 to move the carcase forwardly into the apparatus by engagement of the parts 104*b*, 106*b* with the carcase in the fashion shown in FIG. 9. In FIGS. 8 and 9, one carcase 30 is shown at a position "G" where it has just been so moved by the mechanism 74 and one carcase 30 as shown at a location "H" where it is about to be so-moved. After movement of a carcase 30 forwardly to location "G", the ram 100 is operated to effect a reverse movement of mechanism 74 to revert it to the position shown in FIGS. 8 and 9.

Carcases 30 are sequentially positioned for movement by mechanism 74 by moving them on the conveyor 36, with the mechanism at the positions of FIGS. 8 and 9, by passing them through the elements 104, 106. This movement is effected by forcing apart the elements 104, 106 as these engage parts 104*a*, 106*a* of the elements 104, 106. The consequenct pivoting apart of the elements 104, 106 is accomplished against the aforementioned resilient bias, and this bias acts to revert the elements to the positions shown in FIGS. 8 and 9 after passing of the carcase therethrough.

The sealing bars 50 are carried on vertical frames 116, 118 which are mounted for pivotal movement about vertical axes at locations towards the output end of the apparatus. These axes are designated by reference numerals 120, 122 in FIG. 9. Axes 120, 122 are disposed at locations spaced away from the conveyor rail 36*a*, when the apparatus is viewed in plan. From the axes 120, 122 the frames 116, 118 extend in the direction against the direction of movement of carcases through the apparatus to inwardly extending portions 116*a*, 118*a*, at inner ends of which are located the bars 50. Hydraulic or pneumatic rams 124, 126 are provided actuable to cause movement of the portions 116*a*, 118*a* of the frames so as to swing the frames about the axes 120, 122 from inner positions, at which the bars 50 are adjacent, to outer positions shown, in the case of the frame 116, by the broken lines 116'.

The sheets 12, 14 extend, from the rolls 42, 40 first in the direction of movement of carcases through the apparatus to respective upright rollers 130, 132, thence in the reverse direction to respective rollers 134, 136, thence in the direction of carcase movement again to pass around rollers 138, 140 and thence inwardly so as, in a condition of the frames 118, 116 for sealing as shown in FIG. 9, to extend around the bars 50, thence in the direction of carcase movement rearwardly around respective opposite sides of the carcase which is then positioned at location "G". Thence, the sheets extend through and from the apparatus in the fashion previously described in relation to the embodiment of FIG. 5. The rollers 134, 136 are mounted for movement in planes parallel to the direction of extent of the conveyor 36 so as to be movable from the locations 134, 136 as shown to locations 134', 136' shown in broken lines. The rollers 134, 136 are, however, resiliently biased to the positions shown.

It will be appreciated that the carcases 30 are moved stepwise through the apparatus by the mechanism 74. The carcase 30 as shown in FIG. 9 which is for the time being positioned at location "G" has a vertical heat seal 16 formed therebehind by inward movement of the frames 116, 118 to engage the bars 50 therewith. The frames 116, 118 carry arcuate plates 144, 146 which grip the carcase when the frames are moved so as to bring the elements 50 together whereby to assist in holding the carcase during heat sealing. The heat sealing of the upper and lower edges of the sheets 12 and 14 is effected when carcases are at the last mentioned position "J". The bars 60, 62 are shown mounted for movement by means of hydraulic or pneumatic rams 140, whereby they can be advanced inwardly to engage the sheets for heat sealing. After such formation of a seal 16, the carcase 30 at location "G" is advanced to a new location "J" as the following carcase is moved from location "H" to location "G" by the mechanism 74.

When mechanism 74 is operated to advance the carcases from location "H" to location "G", the carcase formerly at location "H" is, as mentioned, pushed forward to location "J" and as this movement occurs the sheets 12, 14 are brought to either side of the carcase moving to location "H". The lengths of material from sheets 12, 14 necessary for this are taken from the portions thereof between the last formed join 16 and the rolls 42, 40, without unwinding from the rolls, under movement of the rollers 134, 136 against the resilient bias applied thereto so that the rollers move to the positions 134', 136' shown. Later, during the time when the bars 60, 62 are moved to engage the sheets 12, 14 and before next advance of a carcase 30 the spring loading of the rollers 134, 136 operates to revert them to their initial position to withdraw material from the rolls 40, 42.

The described packaging and method of packaging has particular advantage in the packaging of carcases. In particular, the carcases are held together in a single unit which can be easily manipulated by automatic handling apparatus. For example, once the package is formed, the series of carcases 30 therein may be transported together. If the plastics material from which at least one of the sheets 12 and 14 is formed is transparent, it is readily possible to inspect the products contained therein.

The described construction has been advanced merely by way of explanation and many modifications may be made thereto without departing from the spirit and scope of the invention as defined in the appended claims.

I claim:

1. A method of packaging products comprising:

suspending vertically products to be packaged from a conveyor rail system to be moveable in a path of movement along said conveyor rail system;

providing a pair of supply guide rolls having a sheet of flexible and sealable plastic packaging material extending therebetween and being present in substantially equal amounts on each supply roll;

positioning said supply guide rolls on either side of said conveyor rail system such that said packaging material extends between rolls in a vertical plane transverse to said path of movement, said plastic material having a vertical dimension sufficient to package said products;

moving said products along said path of movement into engagement with said packaging material and beyond said vertical plane while unwinding simultaneously said plastic material from both supply rolls, whereby upon movement beyond said vertical plane said products are wrapped by said packaging material; and after wrapping each product, clamping together said plastic material at a location upstream of the said product and sealing said plastic material together along the vertical seam so as to completely wrap around said product.

2. A method of packaging products according to claim 1, further comprising sealing said sheets of plastic material horizontally along the lower edges of said sheets of plastic material downstream of its vertical seam.

3. A method of packaging products according to claim 2, further comprising sealing said sheets of plastic material horizontally above said product with a suspension means to said conveyor rail system extending through the resulting upper seam.

4. An apparatus for packaging products which are vertically suspended comprising:

a conveyor rail system;

wheel support members moveable in a direction along said rail system;

downwardly directed means attached to said wheel support members for vertically suspending products to be packaged, wherein said products are moveable in a vertical plane;

a pair of supply rolls, having plastic sheet material extending therebetween and being wound thereon, said rolls being positioned on either side of said vertical plane such that said sheet material extends transversely to the direction of said rail system and below said rail system; and clamping and sealing means laterally moveable from opposite sides of said rail system towards and away from each other in directions perpendicular to said vertical plane.

5. An apparatus for packaging products according to claim 4, wherein said clamping and sealing means comprises vertically extending clamping and sealing bars having upper and lower ends.

6. An apparatus for packaging products according to claim 5, wherein said clamping and sealing means further comprises clamping and sealing bars horizontally positioned at the level of said upper and lower ends respectively of said vertical bars and positioned downstream from said vertical bars.

7. An apparatus for packaging products according to claim 5, further comprising a pusher mechanism reciprocable in the direction of said rail system and sequentially engageable with said products to incrementally move said products during strokes of said pusher mechanism in said direction of movement of said products.

8. An apparatus for packaging products according to claim 7, said apparatus having a frame and an activating means, wherein said pusher mechanism further comprises a first linkage and a second linkage, each in the shape of a parallelogram, one linkage being positioned on each side of said rail system, each linkage having a first and a second upwardly directed member, said upwardly directed members being pivoted to said frame at locations above said rail system, the locations being spaced along the length of said rail system, wherein said linkages are connected to said activating means.

9. An apparatus for packaging products according to claim 7 wherein said pusher mechanism has at least two pusher elements, said first linkage and said second linkage each carrying one said element, wherein said elements are pivotably interconnected with said linkages about vertical axes located upstream from product-engaging forward parts of said elements, said elements being spring biased towards each other and moveable in a direction so as to allow the passage of a product in the direction of movement of said rail system by swinging outwardly if said product moves between two of said linkages, and which elements do not move outwardly if said elements engage said products with said forward parts.

10. An apparatus for packaging products according to claim 5, wherein said sealing bars are carried by vertical frames mounted for movement about a vertical axis at locations on the output end of said apparatus, said apparatus having means located upstream of said vertical axis being actuable for causing movement of said frames about said vertical axis from an inner position to an outer position.

11. An apparatus according to claim 10, wherein said frames carry arcuate plates which grip said products when said frames are moved toward each other.

12. An apparatus according to claim 4, wherein said plastic material on said supply rolls extends from a first supply roll to a second supply roll over guide rollers positioned on both sides of a vertical plane through said rail system, said guide rollers being moveable parallel to said plane in the direction of movement of said product along said rail system.

* * * * *